United States Patent [19]

Brosenius

[11] Patent Number: 4,601,426

[45] Date of Patent: Jul. 22, 1986

[54] EXCESS-PRESSURE-FREE BOILER AND ACCUMULATOR HEATING SYSTEM

[76] Inventor: K. Hilding Brosenius, Hazeliusbacken 16, Stockholm, Sweden, 115 21

[21] Appl. No.: 693,141

[22] Filed: Jan. 22, 1985

[30] Foreign Application Priority Data

Jan. 27, 1984 [SE] Sweden ..... 8400415

[51] Int. Cl.[4] ..... F24D 3/00

[52] U.S. Cl. ..... 237/59; 237/56; 237/65

[58] Field of Search ..... 237/8 R, 56, 59, 62, 237/65

[56] References Cited

U.S. PATENT DOCUMENTS 3,897,903 8/1975 Race ..... 237/8 R 4,392,610 7/1983 Moskal ..... 237/55

*Primary Examiner*—Henry Bennett

*Attorney, Agent, or Firm*—James & Franklin

[57] ABSTRACT

The heating system includes water-radiators, a heat source as a boiler and/or one or more water-accumulators, an expansion vessel and a pipe-circulation system interconnecting the radiators and the source through which the water is pumped. The system is intended for one-family-houses with normally at most two floors above a cellar or a basement in which the source is situated. The expansion vessel is contrary to conventional open expansion systems arranged below the levels of the radiators in the boiler room and thus frost-free and immediately above or beside the top of the heat source. Its own top is provided with an open outlet to the atmospheric air in the boiler room. Thus the heat source is exposed approximately only for the very low water-pressure from its own water. Contrary to the heat source the radiators with belonging riser- and return-pipes are exposed to the same high water-pressure as at conventional radiator-systems with the expansion vessel situated above the topmost radiators. This pressure is here caused by a circulation pump for rather high pressure, situated at the lower end of the riser-pipe, which pump works in combination with flow-resistance means at the lower end of the return pipe. This pump-combination causes no external water-pressure on the heat source.

6 Claims, 5 Drawing Figures

EXCESS-PRESSURE-FREE BOILER AND ACCUMULATOR HEATING SYSTEM

The present invention relates to hot water heating systems for one-family houses and, more particularly, to a system comprising water-radiators, a heat-source as a boiler and/or one or more water-accumulators, an expansion vessel and a pipe circulation system interconnecting the radiators and the heat source through which the water is pumped by a circulation pump. (Water-accumulator is here a well-insulated larger water-container for storing of heat in heated water).

The system is intended for one-family-houses with normally at most two floors above a cellar or basement, in which the heat source is situated. The expansion vessel is contrary to conventional systems arranged below the levels of the radiators and immediately above or beside the top of the heat source.

The expansion vessel is at its top provided with an open outlet to the atmospheric air in the cellar or the basement. Thus the heat source is exposed only to an insignificant or neglectible excess-pressure.

(The word "excess-pressure" will in this specification mean a water-pressure in a (closed) water container—for example an accumulator, which is larger than the pressure from water, which is filled just up to the top or edge of an open or closed water-container. As soon as a (closed) water container is tightly connected to a water container on a higher level, it will then be exposed to "excess-pressure". If the first container instead has an open outlet at its top no excess-pressure can arise—the container will be "excess-pressure-free". The last expression will rather often be used in this specification).

Contrary to the heat source the radiators and belonging riser- and return-pipes are exposed to the same high water-pressure as at conventional radiator-systems with an expansion vessel arranged above the topmost radiators. At the invention this pressure is caused by a circulation pump for rather high pressure, situated at the lower end of the riser pipe and combined with flow-resistance means, for example an adjustable valve, situated in the lower end of the return pipe.

The invention means a removing of at least two very essential disadvantages at conventional radiator heating systems and thus corresponding advantages at the invention and a considerable simplifying and reduction in costs relatively conventional systems.

It is, therefore, a prime object of the present invention to provide a hot water heating system wherein boiler and/or accumulators are excess-pressure-free and thus not exposed to the high water-pressure at conventional systems.

It is another object of the present invention to provide a hot water heating system wherein the expansion vessel with an open outlet at its top contrary to conventional systems can be situated below the radiators in a boiler room in the cellar or the basement and thus also connected to boiler or accumulator with very short pipes.

It is a further object of the present invention to provide a hot water heating system wherein the expansion vessel is situated frostless in a heated space such as a boiler-room.

It is a still further object of the present invention to provide a hot water heating system wherein the boiler and/or accumulators are excess-pressure-free at the same time as radiators and belonging pipes partly at the same level are exposed to a considerable water pressure.

It is a further object of the present invention to provide a hot water heating system wherein a circulation pump in combination with flow-resistance means provides a high pressure in the radiators and pipe-system at the same time as the boiler and accumulators are excess-pressure-free.

It is a further object of the present invention to provide a hot water heating system wherein the radiator system is kept permanently filled with water also at temporary or longer stop of the circulation pump.

It is a still further object of the present invention to provide a novel and improved method of initial filling of the radiator system with water from the net which removes the air in the radiators and pipes without risk for excess pressure in the system from the net-pressure.

The invention is illustrated by way of example in the accompanying drawings, in which FIG. 1 shows schematically the principle of the invention at a two-floor house with cellar, showing an accumulator which can be heated by electricity or from a connected boiler, radiators in two floors, circulation pump and two different types of expansion vessels. The accumulator can also consist of two or more interconnected water containers.

Figure 3:
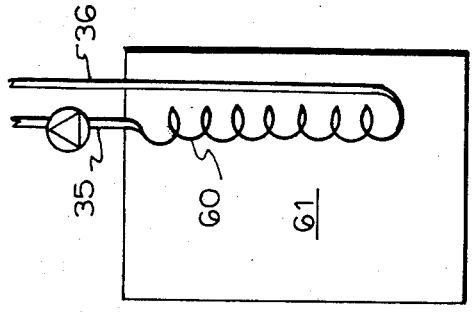
FIG. 3 shows for further comparison with the invention a known but disadvantageous method to remove certain disadvantages at conventional radiator systems.

At the conventional heating system according to FIG. 3 31 and 32 are a number of water-radiators, which are mutually interconnected by branch-pipes 33, 34 at two different floors of an one-family-house. The radiators are with a riser-pipe 35 and a return-pipe 36 connected to a heating source, here made as an accumulator 37 and a boiler 38 connected to the accumulator, both situated on a lower level for example the cellar.

The accumulator 37 can be provided with electrical elements 39 for direct heating of the accumulator-water, and the boiler 38 can be heated in different ways, for example by oil-heating, wood-heating, coal, electricity or other energy types. The boiler can also be used for heating of the accumulator.

The changes in volume of the water of the heating system at varying temperatures will in a conventional way be taken up by the variations in water level 40 of an open expansion vessel 41, which is also situated conventionally above the highest situated radiators, mostly in an attic.

The expansion vessel of a conventional system is att its highest point provided with an open outlet 42, which is open to the atmospheric air. At the level of the water level 40 no external excess-pressure exists in the radiator-system in relation to the atmospheric pressure. Since the whole heating system has been filled with water from the bottom valve of the boiler 43 or the accumulator 44 to the outlet 42 of the expansion vessel above the radiators, a water pressure will exist in the whole water-system which varies from nil at the level of the free water-level 40 of the expansion vessel up to a maximum pressure in the boiler or accumulator, which corresponds to the depth below the water level in the expansion vessel.

Figure 5:
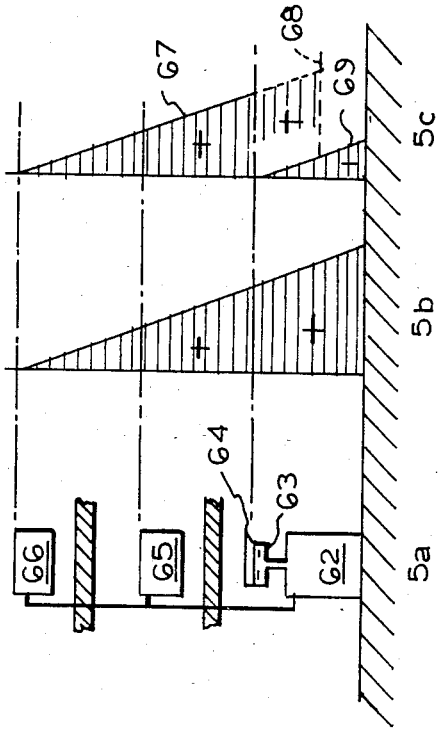
FIG. 5 shows schematically the water pressure at different levels of the invention compared with same pressure at certain known systems.

The water pressure at different levels of a conventional radiator system is schematically shown on the diagram *5b* in FIG. 5.

Instead of expansion vessels of "open type"—which have open outlets—there also exists so called "closed expansion vessels", but as such systems should not be used at accumulator systems, and as they cause about the same pressure in a radiator system as open expansion vessels, no description will be made here of closed expansion vessels.

The conventional and most usually used type of radiator-systems at one-family-houses now described has two very essential disadvantages.

One of these disadvantages is the fact, that the expansion vessel 41, which has to be situated above the highest situtated radiators 32, normally must be placed in a space of the attic, which neither is heated or easy to reach. That makes it necessary to perform long and costly pipes 45 between the accumulator (boiler) in the cellar and the expansion vessel on the attic. It also causes freezing risk for the expansion vessel, which therefore must be carefully insulated. At bad luck the outlet 42 of the expansion vessel can be frozen, which may cause risk for explosion of the boiler at over-heating when its free expansion will be closed.

The other essential disadvantage at conventional radiator systems is, that the boiler and especially an accumulator will be exposed to the high water pressure from the expansion vessel situated at a high level. Accumulator containers then must be made as so called compression tanks, which are subjected to special pressure rules, causing additional costs. The accumulator containers then normally must be made as cylindrical pressure-resisting containers with hived gables 54, FIG. 2, which are quite expensive. Since the cylindric diameter is limited by the demand, that the containers mostly must be transported through narrow cellar doors, the volume of cylindrical containers will be rather limited. Thus several connected cylindrical containers will be needed for the rather large accumulator volume, which normally is required. That also makes a conventional accumulator-system more expensive.

In later years some of these disadvantages have been avoided by arranging a "heat exchanger" between the pressure-exposed radiator water and the accumulator water. A performance according this principle is schematically shown on FIG. 3. The riser- and return-pipes 35 and 36 for the radiators are here connected to both ends of a cupper-spiral 60, which is situated in the accumulator water 61. Then heat can be transferred from the heated accumulator water 61 through the walls of the cupper-spiral 60 to the radiator water without the accumulator water being exposed to the high pressure of the radiator water.

However, a heat exchanger is rather expensive. Additionally the heat transferring through the heat exchanger causes considerable temperature losses as compared to the conventional system. At the conventional system top-heated accumulator water is—as shown on FIG. 2—directly withdrawn from the top of an heat-loaded accumulator at 49, then it passes through the radiator-system 31, 32, governed by its ordinary circulation pump 50. Finally the water, which has been cooled during the passage through the radiators, is returned back into the bottom of the accumulator at 51. From there the entering cooled water 52 presses the hot water above 53 upwards until all the hot water in the accumulator has been withdrawn to the radiators and has been replaced by the colder water 52 from below as directly as possible. A heat exchanger system has not at all this favourable, effective and cheap method to transfer heat without temperature-losses directly from the accumulator to the radiators.

Considering cost and efficiency and referring to the view-points stated above the ideal performance of a radiator-heating system then should fulfil the following demands:

(1) The heat source (accumulator or boiler) should not be exposed to the high water pressure from the radiators and belonging expansion vessel but only to its own water-filling pressure (up to the top 54, 55 of the accumulator or boiler).

Figure 1:
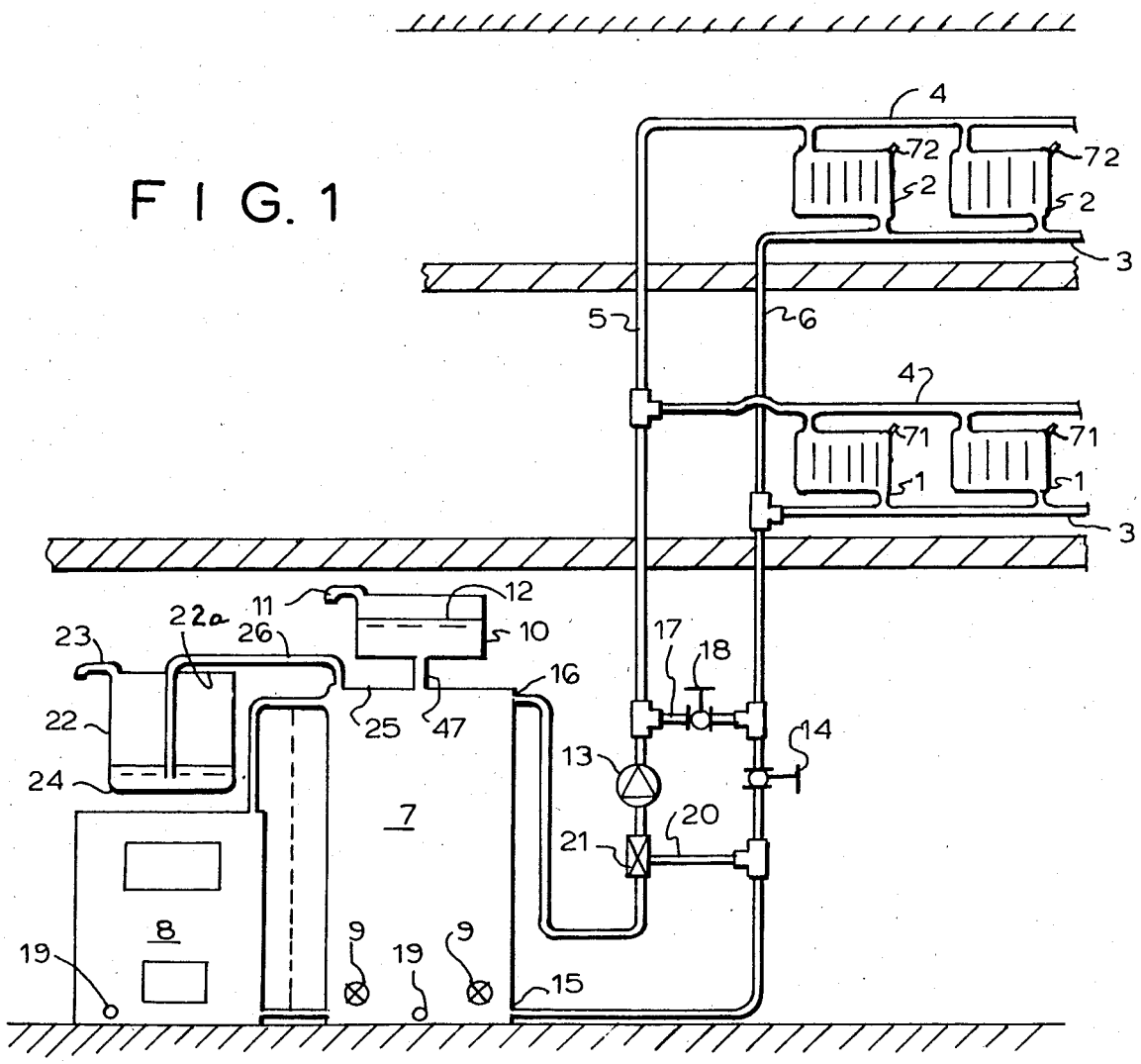

(2) The expansion vessel should be situated frost-free and placed immediately above or by side of the top of an heat source, FIG. 1, with shortest possible pipes to them. The vessel should be provided with an open outlet directly in the boiler room and situated at a level nearest possible to the top of the heat source in order to minimize the excess pressure on the source.

Figure 2:
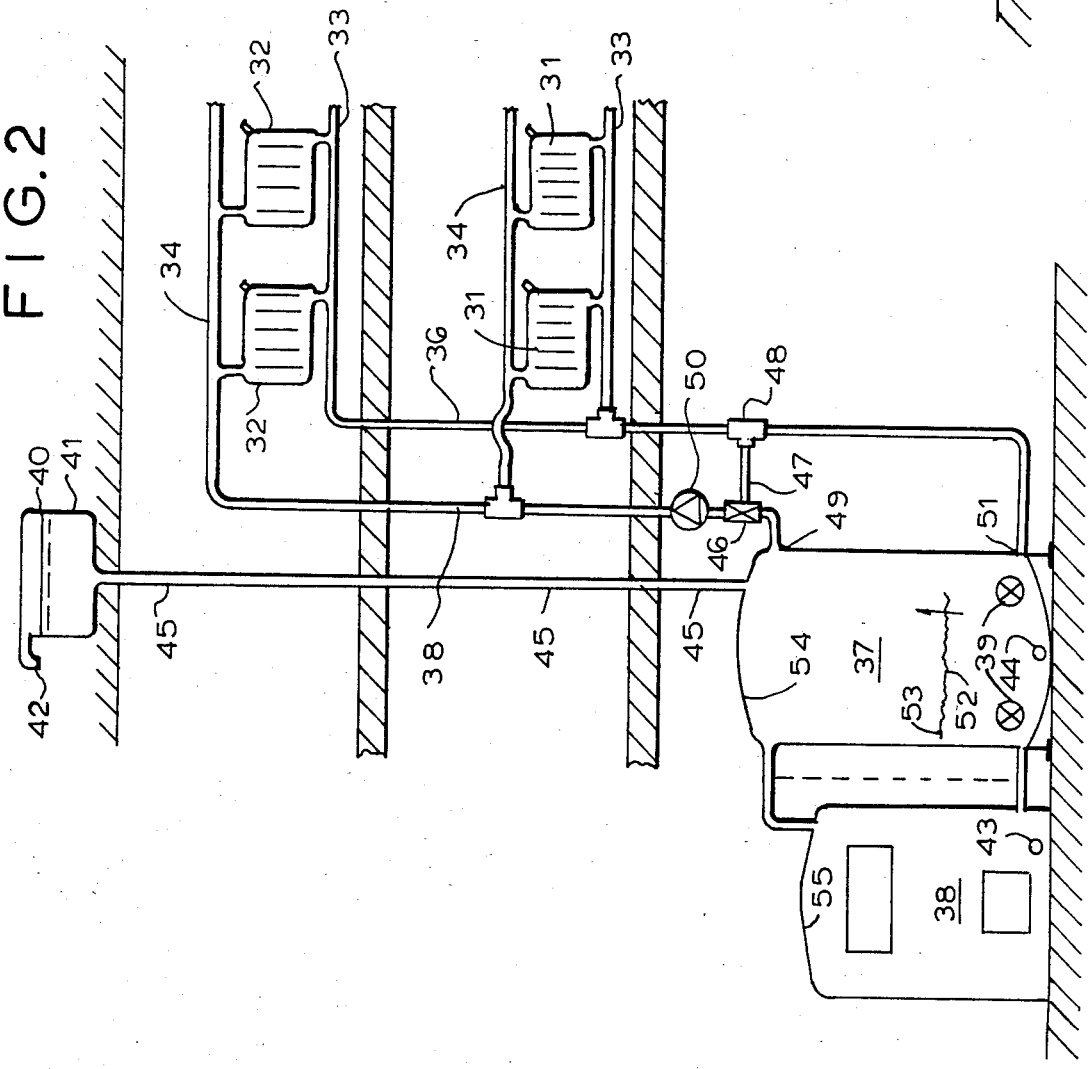
FIG. 2 shows, for comparison with the invention, schematically a corresponding conventional radiator heating system in order to show how the invention has removed at least two very essential disadvantages at such a conventional system.

(3) Heated accumulator- or boiler water should, exactly as at a conventional pressure-exposed system, without temperature-losses be withdrawn from the hot top 49, FIG. 2, of the heat source and thereafter—after passage through the radiators and having been cooled down there—be again transferred back to the bottom 51 of the heat source. Additionally this transport should be made only by assistance of the ordinary circulation pump 50 of the radiator system.

(4) Additionally the system should be as simple as possible to hand, be "fool-proof", be cheap to invest.

From a simple analysis it will be clear that no hitherto known system fulfils all the demands mentioned here.

The most usual conventional radiator-system does not fulfil the demands number (1) and (2).

A heat exchanger system does not fulfil the demads number (3) and (4).

The invention, on the contrary, fulfils all the demands.

A performance of the invention is shown schematically on FIG. 1, which will now be further described, According to FIG. 1 1 and 2 is a number of water radiators, which are mutually interconnected by branch-pipes 3 and 4 on two different floors of an one-family-house. The radiators are with a riser-pipe 5 and a return-pipe 6 connected to a heat source, here made as an accumulator 7 and a boiler 8 which also can heat the accumulator, both situated on a lower level for example the cellar.

The accumulator 7 can be provided with electrical elements 9 for direct heating of the accumulator water, and the boiler 8 can be heated in different ways, for example by oil-heating, wood-heating, coal, electricity or other energy types.

The changes in volume of the water in the heating system will be taken up by the variations in water level 12 of an open expansion vessel 10 or of an expansion vessel 22 of a special type, which will be describad later.

The invention is primarily characterized by a combination of components, which are quite different from corresponding components at conventional radiator systems.

(1) According to the first of these components boiler or accumulator is directly or indirectly connected to an open expansion vessel 10 (or a special expansion vessel 22 later described), which is not situated in the conventional way high above the radiators but instead in the boiler room (or a corresponding space), and thus on a level below the radiators 1, 2. In the boiler room the expansion vessel 10 is placed immediately above the top of an accumulator or boiler or—at the special performance 22—also beside of this top. The expansion vessel is further provided with an open outlet 11 or 23 in the level of the boiler room and at an insignificant distance above boiler-top or accumulatortop. The external water excess-pressure will then be next to nil (zero) at the tops of boiler or accumulator.

Since the expansion vessel, which is connected to a boiler or an accumulator, is provided with en open outlet in the level of the boiler room, and since the radiators with riser- and return-pipes 5, 6 are freely connected to boiler or accumulator, the radiator-water should seemingly be discharged through the outlet downwards of the expansion vessel, if the radiators in a conventional way were filled with water.

(2) According to a second component of the invention, however, the radiator-system is not kept filled with water in a conventional way and under excess-pressure from an expansion vessel above the radiators. Instead the radiator system is kept permanently filled with water by the aid of a special pump-combination. This combination consists partly of a circulation pump 13 with a relatively high pumping pressure, which is situated downwards in the riser pipe 5 of the radiator system, partly of adjustable flowresistance means 14, which preferably is situated downwards in the return pipe 6 of the radiator system.

The flow-resistance means can be made as a conventional adjustable valve 14, but it can also be made in several other ways. If the flow-resistance is increased, the total flow-resistance of the circuit riser-pipe 5—radiators 1, 2—return pipe 6 will be increased, but at the same time the quantity of circulation water will be diminished. According to the invention these conditions are utilized in order to keep also the topmost radiators 2 permanently filled and passed by circulation water during permanent pressure as a result of pump-action in despite of the fact that boiler or accumulator downwards are completely free from external excess-pressure.

By a suitable choice of pressure- and capacity data for the circulation pump 13 and by suitable adjustment of the flow-resistance 14 the water pressure in the current-circuit mentioned can be adjusted so, that the pump-pressure directed upwards immediately above the pump is larger than the static pressure from the radiators 1, 2 directed downwards. At the level of the topmost radiators, where the static radiator-water pressure is nil (zero), the pump-pressure should still be so large, that it is able to keep the radiators filled with water and to force the circulation water to pass also through the topmost radiators with excess pressure and that with such a capacity, that the radiators also at maximum heat demand will be provided with enough heat.

At the way back to the boiler or the accumulator through the return pipe 6 the return water has a water pressure which still is rather large on levels above the flow-resistance 14. Below the flow-resistance 14 the water pressure will according to the invention be suddenly reduced. At the return entrance of the return water into the boiler or the accumulator at 15 the water pressure has decreased to the same pressure which exists at the same level in the boiler or the accumulator. This pressure-adjustment will in reality occur quite automatically. Thus the return water can be returned to the boiler or the accumulator without causing any external excess pressure in them. That in turn is a fundamental basis for the function of the invention.

The diagram in FIG. 5 shows very schematically the water pressure on different levels at the invention and at a conventional system. In FIG. 5*a* is 62 a heat source, 63 is an expansion vessel according to the invention situated immediately above the heat source with an open outlet 64. 65 and 66 represent the radiator systems on first and second floors.

The diagram 5*b* shows the water pressures at a conventional system with a maximum pressure at the bottom of the heat source. (For sake of simplicity the water pressure is assumed to be 0 (nil) at the top of the topmost radiators 66—in reality the pressure in all diagrams should be added with an additional pressure for forcing the water through the radiators).

The diagram 5*c* shows the water pressures at the invention, which is different from known systems. The diagram-line 67 represents the water pressure in riser-pipe and radiators, where 68 represents the level of the circulation pump. In the same diagram the diagram-line 69 shows the pressure in boiler and accumulator. This pressure is 0 (nil) at the level of the water-surface in the expansion vessel and increases with the depth of the heat source. It should be observed the large differens in pressure between the conventional system and the invention. In reality this differens is several times larger than as shown in the diagrams.

As will be clear from FIG. 1 the circulation pump 13 suitably will be arranged a considerable piece of distance below the top of boiler or accumulator. The reason is that also the sucking-side of the pump should stand under pressure from the water of the heat source, that while the pump at starting always will be filled with water under a certain pressure.

An interesting quality of the invention is that at the same time a high pressure can exist in the riser-pipe 5 and return-pipe 6 of the radiator-system on the same level as a low pressure exists in the boiler or the accumulator as shown on the pressure-diagrams in FIG. 5*c*.

A circulation pump with capacities described needs a somewhat larger effect than a conventional circulation pump, which has only to circulate a radiator-water under static equilibrium. Seemingly such a larger effect with a corresponding larger energy-consumption should result in a larger energy-cost. In reality this is not the case. The reason is the fact, that the increased energy-consumption of the pump completely will be transferred in heat, which also will be completely used for heating of the house.

That fact has probably not been observed earlier, which also probably has prevented this very cost-saving invention to be invented! The pump-energy can in fact not result in increased "position-energy" (pumping up water to a higher level), while the whole water quantity of the system as an average always will be situated on the same level. The fact that the increased pump-energy completely will be used for heating the house has additionally been verified by direct measurings. At summertime, when no heating effect is needed, the pump will stand still.

The only additional cost for the system according to the invention is therefore the initial outlay for a somewhat more expensive circulation pump, but this additional cost is insignificant relatively the cost gains of excess-pressure-free boilers or accumulators and relatively the cost gains of the very much cheaper expansion-vessel. The last one can even be delivered combined with the boiler from the production factory, which can represent a new boiler-product.

(3) A third main component of the invention will guarantee the continued function of the system also after a pump stop, and that quite automatically.

It might appear that a heating system, which is quite depending of the continuous function of an electric circulation pump (for the water supply and circulation through the radiators), would be practically unfit for use, as an electrical circulation pump can be stopped by failure of current. A heating system must function with absolute running safety in the long run, especially in wintertime, also if it will be left without attention for a longer time. A heating system, which stops to function, can at strong coldness risk the whole house, as water-filled pipes and radiators can get broken by freezing and the water, for example from the net, can escape into the house.

Such failures of current are not too uncommon. At the return of the current the radiator-water-circulation must automatically start again. That demands in turn that the radiator-system also after some time of failure of current still will be, at least mainly, filled by water.

It might seem that the pump-driven radiator-circulation water at a pump-stop should risk to escape (flow out) downwards through the open outlet of the expansion vessel in the cellar (or another low level).

However, if the radiator-system with pipes is absolutely water- and air-tight, a third component of the invention will cause a special and surprising effect which is utilized at the invention. It is supposed that the house is at most two floors high, possibly, three floors, above a cellar. If so, at a pump-stop the water of the radiators will still remain in the radiators without escaping downwards. It has been shown at the invention that the radiator-system functions as a liquid-barometer, which by vacuum-effect keeps the water in the system in despite of the fact, that riser- and return-pipes via boiler or accumulator are in direct and open water-connection with the opening-provided expansion-vessel downwards.

Such vacuum-effect can at most amount to 10 meter water-column, but at 2-floor houses above the cellar the vacuum only amounts to about 5 meter water-column. At such height of a house the radiator-water then remains in the system at a tight system and after a pump-stop. When the electrical current returns after some time of failure the circulation pump and the water circulation through the radiators will automatically start again, also without any protective measures from the house owner.

At a radiator-system, which is not absolutely tight, for example a system, which has smaller untightnesses at the radiator-valves, air will slowly penetrate the system through the untightnesses, as a certain vacuum exists inside the radiator-system at a pump-stop. When air penetrates the system, its vacuum will be reduced to a corresponding degree, and a certain quantity of water, which corresponds to the penetrating volume of air, will escape downwards and pour out through the outlet of the expansion vessel. If such effect is going on a longer time, it will be a risk that the radiator water will escape downwards to such a degree, that the water-circulation circuit will be broken. When the electric current returns, the water circulation will no longer start and the house remains cold.

However, a fourth component of the invention also prevents such a failure. This component is shown on FIG. 4 and includes two steps, which economically can be made also at ready-built houses.

Figure 4:
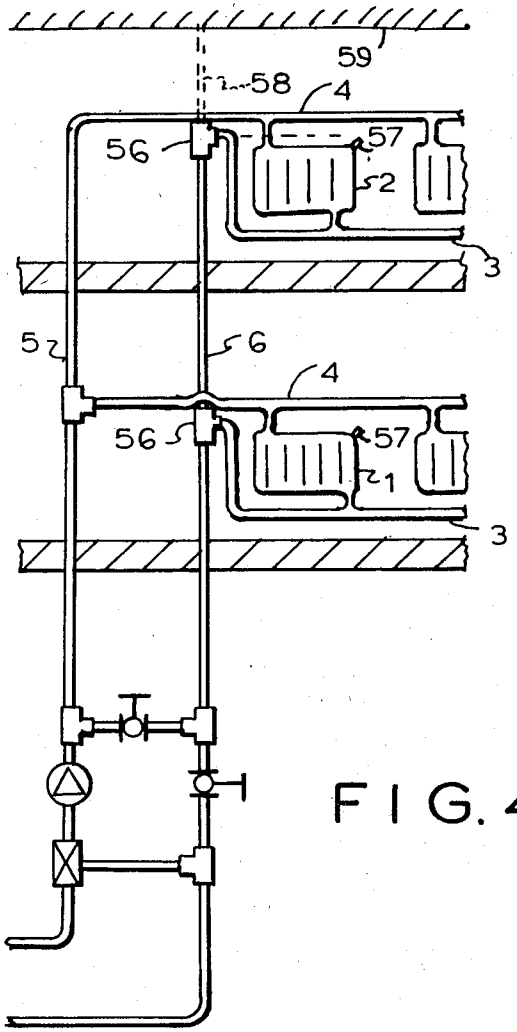
FIG. 4 shows schematically a third component of the invention, showing a special connection between branch-pipes from the radiators to the return pipe of the system.

According to the first step the branch pipe 3 from the bottom connections of the radiators is—at least at the top floor—connected to the return-pipe 6 for the radiator-system at a somewhat higher level 56 than the top 57 of the radiators in the same floor, see FIG. 4. Seemingly the radiator-water should now not att all be able—at the arrangement according to FIG. 4—to escape downwards at pump-stop also if a lot of air would penetrate the radiator-system and consequently the vacuum would not longer keep the water in the radiators. The reason should be, that according to FIG. 4 the return-outlet 56 from the radiators is situated higher than the water-filled tops 57 of the radiators. In reality, however, water will at a pump-stop escape downwards from the radiators without obstacles of said level of the connections between branch-pipes 3 and return pipe 6 of the system. By extensive research work it has been found, that this escaping effect is caused by siphon effect, which still causes the radiator-water to escape downwards if air penetrates the radiator-system through untightnesses. In such a case the heating function of the system will rather soon be broken.

According to a second step of this component of the invention, however, a special thin pipe, suitably a very thin cupper-pipe 58 is connected to the return pipe of the radiatorsystem 6 at its (highest) connection to the branch-pipe 56 mentioned above. This thin pipe 58 should end with an open end near the ceeling 59. This pipe breaks the siphon-effect and brings the water in the radiators to remain there also at a pump stop.

Excessive tests have shown that by combination of the two steps mentioned above, the radiators will not be emptied to a lower level than to the level 57, which corresponds to the connections between the riser-pipe of the system and the radiators. At that level the circulation through the radiator-system will automatically continue again immediately after return of electricity after a failure of current and thus also the heating of the house.

This performance according to the invention is quite independent of vacuum-effect and will function independently of how long time a failure of current will last and that also if the radiators have uncommonly large untightnesses.

Including this component of the system according to the invention the system is then hundred-percent safe to function after returning of current after a failure of current, and also if the house is left without personal attention for a longer time and also if the radiator-system has considerable untightnesses. This safety is a condition for a practically used heating system.

According to a fifth component of the invention the initial water-filling of a radiator-system, which from the beginning is empty, will be made in a special convenient way. The arrangement is shown on FIG. 1. It consists of a transverse pipe 17 between the riser-pipe 5 and the return pipe 6 of the radiator-system. This transverse-pipe is connected to the riser-pipe above the circulation pump 13 and to the return-pipe above the adjustable flow-resistance 14. The transverse pipe is provided with an adjustable valve 18, which also can be closed.

At initial filling of the radiator-system with water the boiler 8 and/or accumulators 7 and the expansion vessel 10 (22) will at first be filled from the water-net by opening of the bottom valve 19 and under pressure from the net. This filling will go on until said containers are completely filled with water. That will be shown by excess water starting to escape through the outlet 11 (23) of the expansion vessel 10 (22) in the boiler room. Thereafter the valve 18 in the transverse-pipe 17 is opened and the flow-resistance valve 14 closed, whereafter the pump 13 is started. The pump now sucks water from the top of boiler or accumulator at 16 and presses this water upwards, partly through the riser-pipe 5, partly via the transverse-pipe 17 through the return-pipe 6 (which then during this loading process also is passed by water upwards and in the opposite direction to normal).

The pumped water presses during the loading process air in the riser- and return-pipes upwards and gradually also in the radiators. The radiators will be filled from below with water by opening successively their venting device 71, 72 and letting out their air-content. After filling of the radiators with water the valves 71, 72 will be successively closed.

Contrary to conventional systems there is at the invention no expansion vessel with an open outlet situated above the radiators. When all radiators are filled with water it is therefore complete "water stop" upwards. In that situation water begins to escape (flow over) from the outlet of the expansion vessel in the boiler room at continued pumping, which means that the whole radiator-system now is completely filled with water. During the water-filling of the radiator-system, which water is withdrawn from boiler or accumulator, this water will successively be replaced by water from the net via the bottom-valve 19.

After the whole system now is filled with water and at the same time all air in pipes and radiators is removed, the valve 18 in the transverse pipe 17 is closed and the flow resistance 14 is adjusted to its normal running position as previously has been described. The system is now ready for continued heating process.

Between riser-pipe 5 and return-pipe 6 is in conventional way arranged a shunt-pipe 20, FIG. 1, with an automatically or manually regulated shunt-valve 21.

The invention can also—without changing of its main principles—be provided with an expansion vessel 22 according to FIG. 1 instead of the expansion vessel 10. The last one is more conventionally situated above the top of a boiler or accumulator. The expansion vessel 22 according to FIG. 1 is arranged with its own top 22*a* just a little above the top of—in this special case—an accumulator. At the expansion vessel 22 its open outlet 23 is also situated above the top of the vessel. On the contrary its bottom 24 is situated quite a distance below the accumulator top 25. This arrangement makes it possible to use largest possible part pf the height space for the accumulators, which therefore can be made with largest possible volume.

Normally an expansion vessel should be situated above the container as is the case with the expansion vessel 10 in FIG. 1. When the water in the heat source contracts, water from the expansion vessel returns to the heat source by gravity through the pipe 27. Consequently it seems techically impossible to arrange an expansion vessel below the top of the heat source container concerned.

The arrangement according to FIG. 1 is, however, based on an idea of the inventor, which uses a certain vacuum-effect. This effect demands that the top part of the container concerned is water-tight and air-tight. A pipe 26 is also quite tightly connected to the top 25 of the heat source container, and ends near the bottom 24 of the expansion vessel 22, FIG. 1.

At maximal heating of the container also its expanding water fills the expansion vessel 22 with heated water up to its top—the excess water escapes through the outlet 23, FIG. 1. When later on the container will be cooler, its water contracts and as a result it sucks water by certain vacuum-effect in the container from the expansion vessel 22 through the pipe 26. This water from the expansion vessel will replace the space which would be left from the contracting water in the container (accumulator), and thus the container will be filled with water up to the top. The arrangement—which needs very little extra height space for the expansion vessel—makes it possible to increase substantially the volumes of accumulators within a given height space in the boiler room or corresponding space.

Summing up, the invention described has a number of essential and cost-saving advantages, for example:

(1) The expansion vessel (10, 22) is with an open outlet (11, 23) situated directly in the boiler room. Thereby it will be frost-free arranged, and it can by shortest possible pipes be connected to boiler or accumulator. It can also be industrially combined with a boiler 8 to a factory-made complete unit. This combination can represent a new boiler-product. At accumulator-systems, which have very much varying temperatures, the expansion water is not exposed to the energy-wasting cooling, which follows a conventional arrangement in a cold attic-space or the like.

At wood-heated boiler an open expansion vessel in the boiler room together with an open outlet will save relatively expensive safety-valves needed in such systems. The frost-free arrangement furthermore eliminates every risk for boiler-explosion as a result of frozen expansion-vessel outlet.

(2) The boiler and the accumulator are not exposed to the high excess-pressure from a highly situated expansion vessel (in the attic or the like). In fact they are exposed practically only to their own water-filling pressure (that is the pressure from water which is filled up to the edge (top) of the container). As a result a larger accumulator-tank can be made as a long and narrow box-shaped tank, which easely can be transported also through narrow cellar-doors or the like, but which still has as large a water volume as a number of cylindrical tanks with the same width and which must be made with expensive pressure-resisting gables.

At conventional systems with a high water-pressure from the radiator-system it is practically impossible to make an accumulator-tank in the cellar as a box-shaped tank which is enough pressure-resisting. Of course the system according to the invention also permits to produce a large accumulator-volume in the shape of two or more minor cylindrical tanks which are connected.

(3) By using one single long but narrow box-shaped tank with a large volume one extra pump with belonging valves, which are necessary to connect several cylindrical tanks, will be saved. That also saves considerable costs.

The system according to the invention nevertheless has—to much lower costs—the same heat-economic efficiency and effectivety as the conventional system with pressure-exposed containers and an expansion vessel in the attic—which system just from view-point of efficiency is ideal. Cooled radiator-return water can, namely, according to the invention during the whole unloading period in a simple way be returned to the bottom of the heat-water-loaded excess-pressure-free accumulators. Thereafter this colder water cuases by continued feeding from below a cold-front, which successively advances upwards and pushes the water above upwards. From the top of the accumulator is in turn all the time top-heated water feeded to the radiator system (or a shunt for such a system) until only a thin layer of hot water is left at the top of the accumulator. Thus the system can utilize a maximum of stored energy in an accumulator with a maximal temperature to the water, which feeds the radiators, and all this with lower investment costs than for conventional systems. In this respect the system is also superior to every heat-exchanger system.

(4) The expansion vessel according to the invention has that same advantage as so called closed expansion vessels as it can be placed in the boiler room and below the radiators, but it avoids the disadvantages of closed expansion vessels. A closed expansion vessel must be provided with several safety valves in order to avoid bursting or explosion of the boiler or accumulator at over-heating. Especially at wood-heating this safety valves are rather expensive (and still not quite safe)—they will be completely avoided at the invention, which has a quite open expansion vessel in the boiler room. At accumulator systems with their larger water volume a closed expansion vessel is quite impossible to use, while the volume variations at varying temperatures are so large, that they cannot be absorbed by a closed expansion vessel. A closed expansion vessel will further cause the same high pressure on a boiler or an accumulator as conventional expansion systems with the expansion vessel placed above the topmost radiators. At the invention the external pressure on the heat source is close to nil (zero).

(5) The radiator system according to the invention is practically independent of normal untightnesses of the radiator- and pipe-system, while it permanently works with excess-pressure on radiators and pipes at the same time as boiler or accumulator are excess-pressure-free. At normal untightnesses—especially at radiator valves—the escaping water will autonatically be replaced by water from the boiler or accumulator. At pump-stop by current failure the water will automatically be kept in the radiators.

Summing up the invention therefore represents an essential technical progress relatively known systems for expansion vessels in combination with heating systems for one-family-houses.

While only a limited number of embodiments of the present invention have been disclosed herein for purposes of illustration, it is obvious that many modifications and variations could be made. It is intended to cover all of these variations and modifications which fall within the scope of the present invention, as defined by the following claims.

I claim:

1. A hot water heating system for heating of one-family-houses with at most two floors above a cellar, comprising a plurality of water-radiators with belonging riser- and return-pipes and branch-pipes to the radiators, a source of hot water, expansion vessel which has an unbroken water-connection to both radiators and heat source and a circulation pump, wherein the expansion vessel is arranged on a lower level than the radiators and situated immediately above or beside the top of the heat source and therefore causing only an insignificant or neglectible excess-pressure on boiler or accumulators and wherein the expansion vessel on said level is provided with an open outlet to the atmospheric air without that the water from the radiators on a higher level, which water has free water connection to the expansion vessel, escapes through said open outlet and wherein at the same time the radiators and belonging pipes are exposed to a large excess-water pressure corresponding to the level in the system of said parts and wherein last mentioned excess water-pressure is caused by a circulation pump, which is arranged downwards in the riser pipe of the system and which is working in combination with a flow-resistance means which is arranged downwards in the return-pipe of the system and whereby said pump in combination with said flow-resistance means continuously can move the circulation water from an essentially pressure-free heat source to permanently pressure-exposed radiators also at the topmost floor.

2. The system of claim 1, wherein the branch-pipe from the bottom-connections to the radiators—at least on the top floor—is connected to the return-pipe for the radiator-system at a somewhat higher level than the top of the radiators on the same floor, and wherein a thin venting pipe is raised a piece upwards from said connections between said branch-pipe and the return pipe, which venting pipe breaks the siphon-action in the return pipe at stop of the circulation pump, and whereby the water content in the radiators will be permanently kept in the radiators at the lowest level of the top-connections of the branch-pipe to the radiators.

3. The system of claim 1, wherein the water in the radiator-system at a temporary pump-stop, for example by failure of current or mechanical pump-failure, by effect of vacuum in the radiator-system is prevented to escape downwards to said source to another degree than what possible untighnesses reduces the vacuum in an otherwise tight radiator-system.

4. The system of claim 1, wherein the return-pipe from the radiators at its bottom end is connected to a return-inlet at the bottom of a boiler or an accumulator, and where the riser-pipe to the radiators at its bottom end is connected to a hot-water-outlet at the top of the boiler or accumulator, and wherein during the running-time of the circulation-pump cooled radiator-return-water, which has returned through said return-inlet, by layering-action will press hotter water above in the boiler or in one or more serie-coupled accumulators upwards, which water in turn feeds the riser-pipe with the hotter water in the top of the boiler or in that accumulator, which is the last one in a serie of serie-coupled accumulators, which are affected by said layering-action.

5. The system of claim 1, wherein between said riser-pipe and said return-pipe is arranged a transverse-pipe, which is provided with an adjustable throttle-valve, the transverse-pipe of which is situated a piece above the the circulation pump in the riser-pipe and a piece above the flow-resistance means in the return pipe, and whereby at initial water-filling of the radiator-system by opening of the valve in the transverse pipe and closing of the flow-resistance valve in the return pipe water from the pressure-side of the circulation pump by pump-pressure from below is caused to flow both through riser- and return-pipes and through radiators with branch-pipes and whereby at the same time in the system existing air before its filling with water is forced to disappear upwards by opening the usual venting device valves of the radiators and whereby at last—after successive closing of the same venting valves—the whole radiator-system with pipes will be completely free from air and filled by circulation water.

6. The system of claim 1, wherein between riser-pipe and return-pipe in a conventional way is arranged a shunt-pipe with an automatically or manually adjustable shunt-valve.

* * * * *